US010688555B2

(12) United States Patent
Meishner et al.

(10) Patent No.: US 10,688,555 B2
(45) Date of Patent: Jun. 23, 2020

(54) METHOD AND CASTING MOULD FOR THE MANUFACTURE OF CAST PARTS, IN PARTICULAR CYLINDER BLOCKS AND CYLINDER HEADS, WITH A FUNCTIONAL FEEDER CONNECTION

(71) Applicant: Nemak Wernigerode GmbH, Wernigerode (DE)

(72) Inventors: Henning Meishner, Wernigerode (DE); Alexander Wagner, Wernigerode (DE)

(73) Assignee: Nemak Wernigerode GmbH, Wernigerode (DE)

( * ) Notice: Subject to any disclaimer, the term of this patent is extended or adjusted under 35 U.S.C. 154(b) by 0 days.

(21) Appl. No.: 14/761,656

(22) PCT Filed: Jan. 20, 2014

(86) PCT No.: PCT/EP2014/051030
§ 371 (c)(1),
(2) Date: Jul. 17, 2015

(87) PCT Pub. No.: WO2014/111573
PCT Pub. Date: Jul. 24, 2014

(65) Prior Publication Data

US 2015/0352631 A1 Dec. 10, 2015

(30) Foreign Application Priority Data

Jan. 18, 2013 (DE) ..... 10 2013 100 540

(51) Int. Cl.
*B22C 9/08* (2006.01)
*B22C 9/02* (2006.01)
(Continued)

(52) U.S. Cl.
CPC ..... *B22C 9/02* (2013.01); *B22C 9/08* (2013.01); *B22C 9/082* (2013.01); *B22C 9/088* (2013.01);
(Continued)

(58) Field of Classification Search
CPC .. B22C 9/10; B22C 9/24; B22C 9/082; B22C 9/088; B22D 15/00
See application file for complete search history.

(56) References Cited

U.S. PATENT DOCUMENTS 1,396,341 A * 11/1921 Rautenbach ..... B22C 9/06 164/108
2,110,455 A * 3/1938 Steele ..... B60B 17/00 164/127
(Continued)

FOREIGN PATENT DOCUMENTS

CN 202079258 U 12/2011
CN 202461429 U 10/2012
(Continued)

*Primary Examiner* — Kevin E Yoon
*Assistant Examiner* — Jacky Yuen
(74) *Attorney, Agent, or Firm* — The Webb Law Firm

(57) ABSTRACT

The present invention relates to a method for casting of cast parts in which molten metal is poured via a feeder, separate runners, or casting channels into a mould cavity defined by a casting mould and modeling the shape of the cast part, whereby the casting mould includes mould parts which determine the shape of the cast part to be cast. Molten metal is conveyed via at least two connections into at least two sections of the mould cavity which correspond to different planes of the part to be cast. At least one of the connections is designed as an additional channel leading through one of the mould parts and independent of the contour of the cast part to be cast. The present invention also relates to a casting mould as described above.

5 Claims, 2 Drawing Sheets

(51) Int. Cl.

| | |
|---|---|
| ***B22D 15/00*** | (2006.01) |
| ***B22D 27/04*** | (2006.01) |
| ***B22D 35/00*** | (2006.01) |
| ***B22C 9/10*** | (2006.01) |

(52) U.S. Cl.
CPC ..... *B22C 9/10* (2013.01); *B22D 15/00* (2013.01); *B22D 27/04* (2013.01); *B22D 35/00* (2013.01)

(56) References Cited

U.S. PATENT DOCUMENTS

| | | | | | |
|---|---|---|---|---|---|
| 2,305,071 | A * | 12/1942 | Fahlman | ..... | B22C 9/06<br>164/342 |
| 5,058,655 | A | 10/1991 | Derp et al. | | |
| 7,753,103 | B1 * | 7/2010 | Rochester | ..... | B22C 9/10<br>164/137 |
| 2013/0087299 | A1 * | 4/2013 | Williamson | ..... | B22D 25/02<br>164/47 |

FOREIGN PATENT DOCUMENTS

| | | | | | |
|---|---|---|---|---|---|
| CN | 202479451 | U | | 10/2012 | |
| DE | 4244789 | A1 | | 12/1994 | |
| GB | 146195 | A | * | 7/1921 | ..... B22C 9/24 |
| JP | 58084639 | A | * | 5/1983 | ..... B22C 9/28 |
| JP | 59166346 | A | | 9/1984 | |
| JP | 6117343 | A | | 1/1986 | |
| JP | 01107957 | A | * | 4/1989 | |
| JP | 683139 | U | | 11/1994 | |
| JP | 2006205228 | A | | 8/2006 | |

* cited by examiner

METHOD AND CASTING MOULD FOR THE MANUFACTURE OF CAST PARTS, IN PARTICULAR CYLINDER BLOCKS AND CYLINDER HEADS, WITH A FUNCTIONAL FEEDER CONNECTION

CROSS-REFERENCE TO RELATED APPLICATIONS

This application is the United States national phase of International Application No. PCT/EP2014/051030 filed Jan. 20, 2014, and claims priority to German Patent Application No. 2013 100 540.3 filed Jan. 18, 2013, the disclosures of which are hereby incorporated in their entirety by reference.

BACKGROUND OF THE INVENTION

Field of the Invention

The invention relates to a method for the casting of cast parts, in which molten metal is poured via a feeder or separate runners or casting channels into a mould cavity that is defined by a casting mould and models the shape of the cast part, whereby the casting mould comprises mould parts that determine the shape of the cast part to be cast.

In addition, the invention relates to a casting mould for the manufacture of cast parts from molten metal, whereby the casting mould defines a mould cavity and comprises mould parts, which determine the shape of the cast part to be cast, and also a feeder or separate runners or casting channels, via which the molten metal reaches the mould cavity when it is poured.

The method according to the invention and the casting mould according to the invention are specially set up for the casting of cast parts using gravity casting.

Possibilities for the molten metal are melts consisting in particular of light metals and their alloys, in particular of aluminium or its alloys.

Description of Related Art

With cylinder blocks in particular, the challenge exists of achieving optimum component properties in each of the different component areas. For this purpose, these areas must solidify at different rates. Areas in which rapid solidification is necessary are therefore specifically cooled down. This process can result in a delicate disruption of the solidification process. Directed solidification can, as a rule, no longer be achieved. Reliable feeding of the resulting thermal centres in component areas located in the interior of the cast part is jeopardised at the same time.

Against the background of the prior art outlined above, the object of the invention consisted of specifying a casting method and a casting mould which ensures the manufacture of functional and flawless cast parts even under the conditions outlined above.

SUMMARY OF THE INVENTION

The invention is based on the idea to functionally link, for the manufacture of cast parts, the feeder or runner or casting channel, via which the melt is poured into the casting mould, to the mould cavity of the casting mould. The link of the feeder is realized, according to the invention, in that it extends through mould parts which determine the shape of the cast part, the link extending, in particular, across several planes of the component to be cast.

With the method according to the invention for the casting of cast parts, molten metal is hence poured, in a way that is known per se, via a feeder or separate runners or casting channels into a mould cavity that is circumvent by a casting mould and that defines the shape of the cast part, the casting mould comprising mould parts which determine the shape of the cast part to be cast. According to the invention, the melt is now conveyed via at least two connections in at least two areas, which correspond to different planes of the cast part to be cast, into the mould cavity, at least one of the connections being designed as an additional channel that leads through one of the mould parts and is independent of the contour of the part to be cast.

Accordingly, a casting mould according to the invention for the manufacture of cast parts from molten metal defines a mould cavity and has mould parts which determine the shape of the cast parts to be cast, and also a feeder or separate runners or casting channels via which, during pouring, the molten metal enters the mould cavity. According to the invention, with such a casting mould the feeder or the runners or casting channels are connected by means of at least two connections, of which at least one is designed as an additional channel that leads through one of the mould parts and is independent of the contour of the cast part to be cast, to at least two areas of the mould cavity which correspond to different planes of the component to be cast.

Accordingly, with the method according to the invention or with a casting mould according to the invention the melt can enter the casting mould in the usual way from the feeder or from the runners or casting channels provided in each case in a way that is known per se via channels which, in the finished cast part, form a part of this cast part. According to the invention, the molten metal can, however, flow via at least one additional connection into the mould cavity, which is led as an additional channel independent of the later shape of the cast part to be created, through one of those mould parts which determine the contour of the cast part.

According to the invention, therefore, through a suitable design of the components of a casting mould that determine the shape of the cast part, the thermal centres in the inside of the component are directly linked to the feeder connected to the casting mould. This is achieved by means of additional feed channels which are led through the contour-giving mould parts and are connected in the critical areas to the component or the mould cavity of the casting mould determining the shape of the component.

"Contour-giving mould parts" is understood here to mean all the parts of the casting mould by means of which the shape of the cast part is determined. This includes, in particular, casting cores that are inserted into the casting mould in order to reproduce recesses, cavities and the like in the cast part.

The casting mould may be a sand mould or a permanent mould.

The casting mould comprises a feeder, whereby this feeder accommodates the volume of molten metal required to feed the casting mould. The feeder here may be constructed as what is referred to as a "feeder core" which is placed on or next to or integrated in the casting mould. The feeder core may be designed in such a way that it not only contains the feeder volume required to balance out shrinkage but also the feeder contour required for the distribution of the melt within the casting mould. Typically, the feeder core is designed in such a way that it finishes the casting mould at the top during solidification.

The invention hence makes available a method and a casting mould for the manufacture of cast parts in which the mould cavity of the casting mould that determines the shape of the cast part is filled with liquid metal, whereby mould parts are inserted into the mould cavity which model the component geometry subsequently.

The invention is particularly suitable for gravity casting methods which include all conventional and dynamic permanent mould casting methods as well as low-pressure casting methods.

At the same time, the invention is not only suitable for all casting methods in which the feeder, during solidification, is arranged on the upper side of the casting mould. On the contrary, it is in principle likewise conceivable to use the advantages of the invention for other casting methods in which, likewise, the problem exists that in the course of the solidification the access of the melt to neighbouring other sections of the mould cavity is restricted as a result of a metal solidifying at an earlier stage in one section of the mould cavity.

The filling of the casting mould with melt and the solidification of the cast part thus usually occur under conditions of gravity. In this case, the feeder typically sits on what, viewed in the direction of gravity, is the upper side of the casting mould. The casting mould may have one or more areas in which the rate of solidification is to be significantly accelerated vis-à-vis other areas or sections of the casting mould.

The accelerated cooling down can occur in a way that is known per se by means of cooling elements, often also termed "chills" or "cooling moulds", which are placed in the casting mould and bring about a locally restricted increase in the rate of solidification in certain areas of the casting. To this end, the cooling elements normally consist of a material whose thermal conductivity is higher than the material of the casting mould adjacent to it.

With permanent moulds in which for example at least the external and/or side parts and the bottom part itself consist of materials with good thermal conductivity, the relevant contour-forming mould parts (bottom part, external and/or side part) per se already form cooling elements on which premature solidification can occur. In these cases, too, it may of course be expedient to provide, in a manner according to the invention, at least one additional channel which circumvents the areas which prove critical in such permanent moulds in respect of the solidification process and a disruption to flow caused by this and thus guarantees a supply to sections of the moulded cavity of the casting mould lying outside of the critical areas.

According to the invention the feeder, when viewed in the direction of solidification, i.e. viewed in the direction in which the molten metal solidifies in the casting mould after being poured, is connected in various component planes.

According to the invention, for this purpose feeder connections or feed channels are provided in the casting mould which are not part of the component geometry and via which the melt can reach certain sections or areas of the moulded cavity of the casting mould.

According to the invention, the feeder links or feed channels can be guided through the contour-forming mould parts. It is also conceivable, however, to guide the feeder connections or feed channels through other mould parts of the casting mould. In this way, appropriate channels can also be guided through the external parts of the casting mould in order to supply certain zones of the mould cavity, in which the cast part is reproduced, in a targeted way with molten metal.

In the contour-forming mould parts, cooling elements may be provided in order, in the particular zone of influence of the cooling elements, to bring about an accelerated solidification of the casting metal.

In order to prevent the molten metal present in the feeder channels or connections from solidifying prematurely, a wall may be provided between the particular cooling body and the particular feeder channel or the particular feeder connection link which possesses reduced thermal conductivity and thus thermally insulates the cooling body against the feed channels. In particular, the wall may consist of moulding sand from which the particular contour-forming mould part is also shaped.

If cooling elements are present, the feeder connections or channels moulded into at least one of the contour-forming mould parts may be guided in such a way that molten metal, avoiding the zone in which the particular cooling body brings about accelerated solidification, is conveyed to a zone of the cast part in which the solidification is to take place more slowly. In this way, the zone of slow solidification is also supplied reliably with molten metal even if a zone is present between the feeder and the relevant zone in which accelerated cooling is to take place and in which, consequently, there is the danger that material that has already solidified impedes the inflow of further molten metal into the zone which is supposed to solidify more slowly.

With the invention, cast parts of complex shapes can be produced in which it is possible for solidification to occur at different rates at different points without this increasing the complexity of the casting mould to an appreciable degree. Cast parts for whose manufacture the invention is particularly suitable include cylinder heads and cylinder blocks for combustion engines.

With a complex design, in particular, the invention guarantees the manufacture of flawless cast components, as a result of which it is particularly suitable for the casting of cylinder blocks while fulfilling very high requirements relating to strength values in the area of the main bearings and in the area of the cylinder bar.

DETAILED DESCRIPTION OF THE INVENTION

Figure 1:
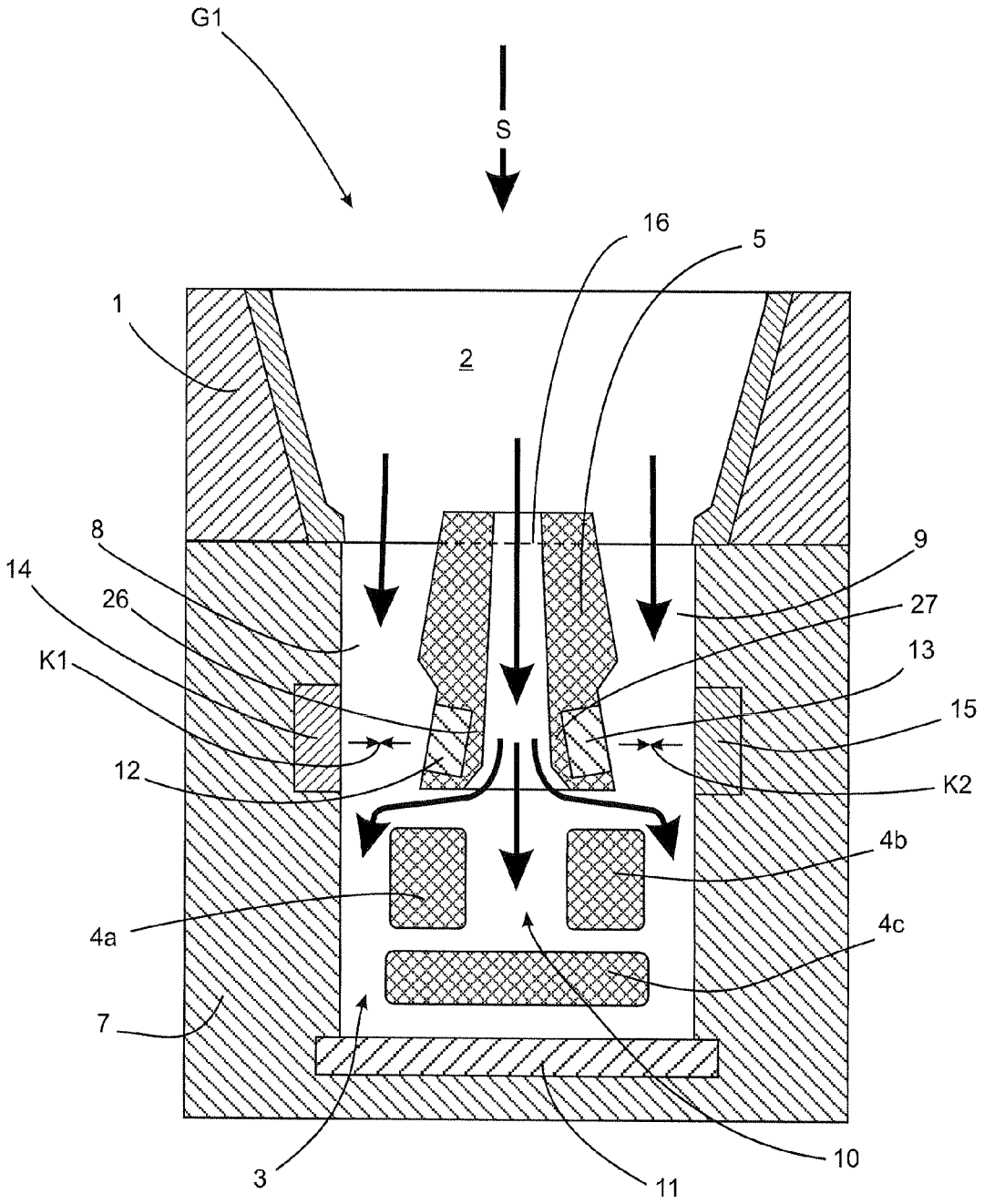
FIG. 1 shows a vertical cross-sectional view of a first embodiment of a casting mould according to the present invention.
Figure 2:
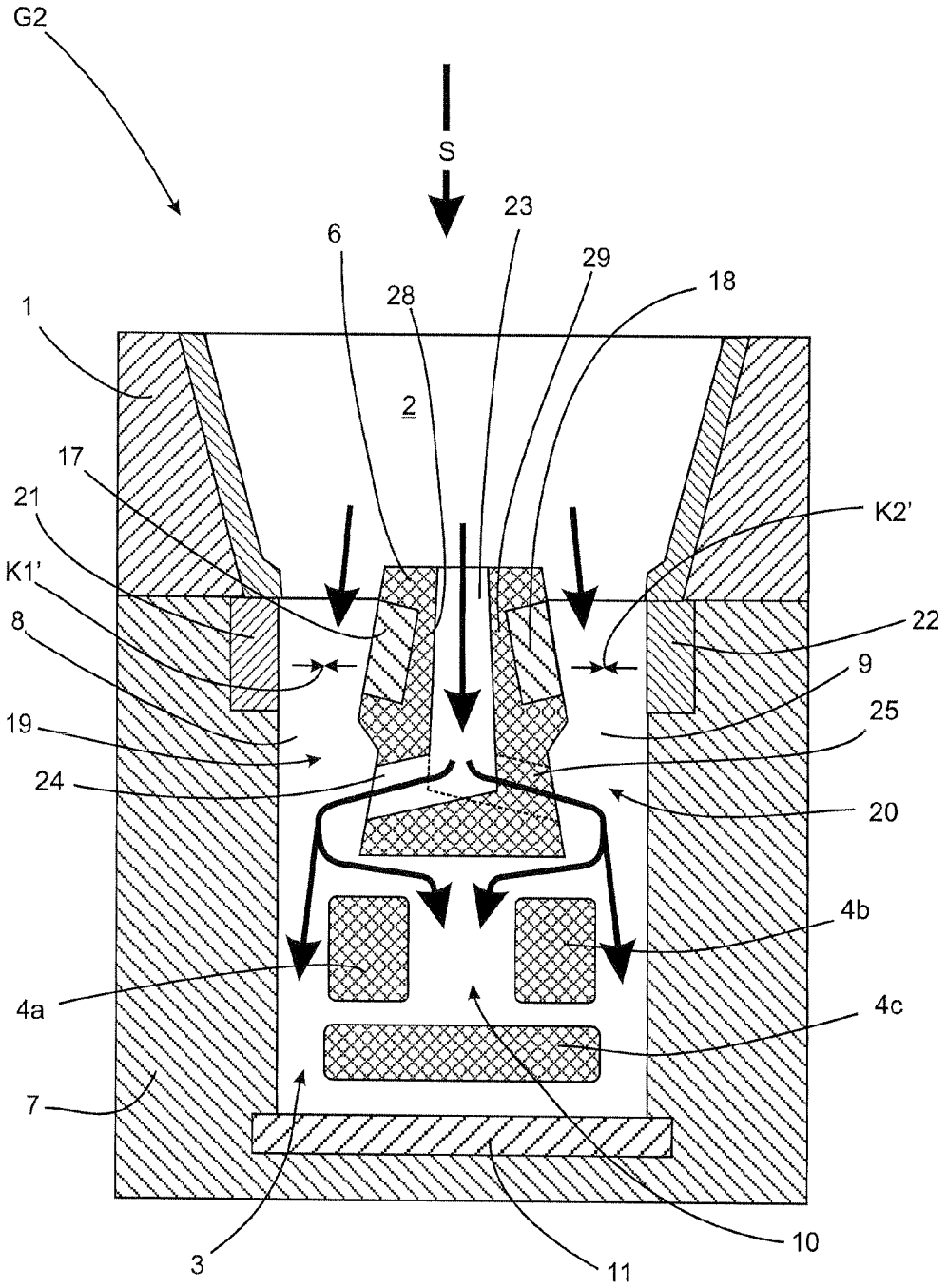
FIG. 2 shows a vertical cross-sectional view of a second embodiment of a casting mould according to the present invention.

In the case of casting moulds G1, G2, the feeder core 1 acting as a gravity feeder forms, in each case, the upper edge of the particular casting mould G1, G2. The feeder core 1 surrounds a feeder 2 via which the filling of the mould cavity 3 with molten metal takes place the cavity 3 being in each case surrounded by the casting mould G1, G2. The filling of the casting mould G1, G2 can equally take place, in a way that is known per se, via separate runners and casting channels.

In casting mould G1, G2, contour-giving mould parts 4*a*, 4*b*, 4*c* are provided in each case. In addition, casting mould G1 has a contour-giving mould part 5 and casting mould G2 has a contour-giving mould part 6.

Mould parts 4*a*-4*c* and 5 and 6 are in each case designed, in a way that is known per se, as casting cores and shaped from moulding sand. They are placed in the mould cavity 3 that is defined by the particular external mould parts 7 of the casting moulds G1, G2 and reproduce recesses, cavities and channels in the cast part to be cast. Accordingly, the mould parts 4*a*-4*c* and 5, 6 are destroyed when the core is removed from casting mould G1, G2. Whilst the mould parts 4*a*-4*c* and 5, 6 determine the inner contour of the cast part to be cast, the external parts 7 determine its outer contour.

The mould parts 5, 6 are positioned within the particular mould cavity 3 in such a way that they border the particular feeder core 1 on their upper side and at the same time are arranged centrally in mould cavity 3 of the particular casting mould G1, G2. In this way the mould parts 5, 6 delimit, within the mould cavity 3, two side areas 8, 9 from one another which, for example, represent the side walls of the cast part to be cast.

In the direction of gravity S beneath the mould parts 5, 6, a further section 10 is present in each case in which the other contour-forming mould parts 4*a*-4*c* of the particular casting mould G1, G2 are located.

With the exemplary embodiments shown here, the particular mould parts 5, 6 each form, with their upper side allocated to the feeder 2, the bottom of the relevant feeder 2. During casting operations, the molten metal present in feeder 2 is hence present on the particular mould part 5, 6. With a practice-oriented design, the feeder 2 will, in the usual way, have a separate bottom indicated in FIG. 1 by means of a dotted line, into which through-holes are moulded which are congruent to the openings of the side areas 8, 9 that correspond to those of the feeder, so that during pouring through the through-holes, the molten metal flows through the openings into the side areas.

In the bottom area of the mould cavity 3 of the casting moulds G1, G2, one cooling element 11 is provided in each case. The molten metal present on the cooling element 11 after the filling of the particular casting mould G1, G2 solidifies more rapidly than the molten metal standing above it owing to the higher heat discharge taking place there. This results in a solidification of the molten metal filling the mould cavity 3 directed against the direction of gravity S.

With casting mould G1, in each case a cooling element 12, 13 is located in the sides of the mould part 5 that correspond to the areas 8, 9 and adjacent to what, viewed in the direction of gravity S, is its lower edge.

Likewise, with casting mould G1, in each case a further cooling element 14, 15 is located in the, in each case, opposite sides of the external mould parts 7 that correspond to the areas 8, 9. Molten metal that enters the section K1, K2 that is present between the corresponding cooling elements 14, 12 and/or 15, 13 consequently solidifies more rapidly than the molten metal which is present in the direction of gravity S above and beneath these sections K1, K2.

In order to reliably supply section 10 of the mould cavity 3 which is present beneath the sections K1, K2, with the molten metal stored in feeder 2, in the case of casting mould G1 a feeder channel 16 is moulded into the mould part 5 the feeder channel 16 extending in a vertical direction from the upper side of mould part 5 that is allocated to the feeder 2 to its lower side that corresponds to the lower section 10 of the mould cavity 3.

With the exemplary embodiments depicted here, the feeder channel 16 leads directly to feeder 2. As long as the practice-oriented design already mentioned above, indicated here only by means of a dotted line in FIG. 1, in which the feeder 2 has a separate bottom, is selected, then it goes without saying that a distinct through-hole is moulded into the bottom of feeder 2 for the mouth of the feeder channel 16 that corresponds to the feeder 2.

The molten metal present in feeder 2 hence, in the case of casting mould G1, reaches section 10 of the mould cavity 3 not only via the side areas 8, 9 but also via the feeder channel 16 in mould part 5. In this way, the molten metal flowing through the feeder channel 16 circumvents the critical sections K1, K2 and ensures that section 10 is continuously supplied with melt even if molten metal is already solidifying in the sections K1, K2 and the flow there is impeded.

In the case of casting mould G2, a cooling element 17, 18 is in each case likewise located in the sides of the mould part 6 that correspond to the areas 8, 9. Unlike with casting mould G1, the cooling elements 17, 18 are arranged in a staggered way, opposite the direction of gravity S, in the direction of the upper side of the mould part 6, so that beneath them, another narrow section 19, 20 of the side areas 8, 9 is present in each case which leads to the lower section 10 of the mould cavity 3 of the casting mould G2. Likewise, in each case a further cooling element 21, 22 is located in the particular opposite sides of the external mould parts of the casting mould G2 that correspond to the areas 8, 9.

Molten metal that reaches the section K1', K2' that is present between the corresponding cooling elements 17, 22 and/or 18, 21 consequently solidifies more rapidly than the molten metal that is present in the direction of gravity S above and beneath these sections K1', K2'.

In order to reliably supply the sections 10, 19, 20 of the mould cavity 3 of the casting mould G2 which, in the case of casting mould G2, are present beneath the sections K1', K2', with molten metal stored in feeder 2, with G2 a feeder channel 23 is moulded into the mould part 6 which extends in an upper section from the upper side of the mould part 6 that corresponds to the feeder 2 in a vertical direction up to a branch point at which it branches into alternately arranged branches 24, 25. It goes without saying that each of the branches 24, 25 may also be connected via a distinct feeder channel 23—that is moulded into the mould part 6—to the feeder 2.

The branches 24, 25 lead, in a sideways direction, to in each case one of the sides of mould part 6 that correspond to the areas 8, 9. The one branch 24 leads to section 19 of the side area 8, whilst branch 25 leads to section 20 of the side area 9. In this way, the sections 19, 20 present beneath the critical sections K1' and K2' can be supplied with molten metal until the solidification of the molten metal present therein. Likewise the lower section 10 of the mould cavity 3 present beneath the mould part 6 is via this route, avoiding the critical sections K1', K2', supplied with molten metal.

The molten metal present in feeder 2 hence, in the case of casting mould G2, reaches section 10 of the mould cavity 3 not only via the side areas 8, 9 but also via the feeder channel 23 and its branches 24, 25. By this means, it is ensured that sections 10, 19, 20 of the casting mould G2 are continuously supplied with melt even if molten metal is already solidifying in the sections K1', K2' and the flow there is impeded.

In order to prevent the molten metal flowing in the particular feeder channel 16, 23 of the casting moulds G1, G2 during pouring from solidifying prematurely, a wall 26, 27 or 28, 29 is provided in each case—with casting mould G1 between the particular cooling element 12, 13 and the feeder channel 16 and with casting mould G2 between the cooling elements 17, 18 and the feeder channel 23; the wall consists of the mould part material from which the mould parts 5, 6 are manufactured in the usual way and which has a reduced thermal conductivity vis-à-vis the cooling elements 12, 13, 17, 18.

The invention therefore makes it possible to reliably supply different areas and sections of the mould cavity within the casting mould with melt even if, in other areas, molten metal is already solidifying or the flow of molten metal is impeded for other reasons. Accordingly, during the casting of cast parts according to the invention, some component areas can solidify significantly earlier than others. For example, with the examples shown in the figures, the melts in the upper and inner areas connected to the feeder via the particular feeder channel 16, 23 in each case set more slowly than the molten metal present in the sections K1, K2 or K1', K2'. Independently of this, however, the upper and lower areas can also be enabled, which solidify at the same time.

One advantage resulting from the fact that the feeder channels are preferably moulded into a contour-giving mould part that is arranged in the mould cavity is that this design of the invention makes it possible to release the cast parts in a partially hardened state, i.e. not yet fully solidified, from the external mould parts. Removal of the component can therefore, also with the invention, take place even when the condition of the feeder 2 is still dough-like.

REFERENCE SYMBOLS

G1, G2 Casting moulds
K1, K2 Sections of the mould cavity 3 of the casting mould G1 present between the cooling elements 14, 12 or 15, 13 corresponding to one another
K1', K2' Sections of the mould cavity 3 of the casting mould G2 present between the cooling elements 17, 22 or 19, 21 corresponding to one another
S Direction of gravity
1 Feeder core
2 Feeder
3 Mould cavity
4*a*-4*c* Mould parts
5 Mould part
6 Mould part
7 External mould parts
8, 9 Side areas of the mould cavity 3
S Direction of gravity
10 Lower section of the mould cavity 3
11 Cooling element
12, 13 Cooling element
14, 15 Cooling element
16 Feeder channel
17, 18 Cooling element
19, 20 Narrow sections
21, 22 Cooling element
23 Feeder channel
24, 25 Branches of the feeder channel 23
26, 27 Walls
28, 29 Walls

The invention claimed is:

1. A casting mould for casting of cast parts from a molten metal comprising:

a plurality of mould parts, which determine a shape of the cast part to be cast and define a mould cavity having a first end and a second end;

a gravity feeder comprising a single chamber, which is located at the first end of the mould cavity and is connected to all openings at the first end of the mould cavity via which, during pouring, the molten metal reaches the mould cavity; and at least two connection links connecting the chamber to at least a first section of the mould cavity and a second section of the mould cavity, the first section of the mould cavity being positioned at the first end of the mould cavity, and the second section of the mould cavity being positioned at the second end of the mould cavity, such that the second section lies in a direction of influx of the molten metal beneath the first section, wherein at least one of the connection links is an additional channel that leads through one of the plurality of mould parts and comprises a sidewall that does not define any portion of the contour of the cast part to be cast, wherein the molten metal enters the feeder and flows through the at least two connection links and flows into the first section of the mould cavity and the second section of the mould cavity in the direction of gravity from the first end of the mould cavity to the second end of the mould cavity, and wherein the first section connected via the connection links is designed such that at least a portion of the molten metal entering the first section solidifies more quickly than the molten metal entering the second section via the connection links.

2. The casting mould in accordance with claim 1, wherein at least one of the plurality of mould parts includes at least one cooling element on at least a portion of its outer surface.

3. The casting mould in accordance with claim 2, wherein the at least one cooling element is at least partially in contact with the mould cavity.

4. The casting mould in accordance with claim 2, wherein between the at least one cooling element and the additional channel, a wall is provided that has reduced thermal conductivity relative to the at least one cooling element.

5. The casting mould in accordance with claim 1, wherein the additional channel leads to the second section of the mould cavity.

* * * * *